United States Patent [19]

Dayger et al.

[11] 4,440,079

[45] Apr. 3, 1984

[54] CONTROL SYSTEM FOR TIMING HAMMERS OF IMPACT PRINTERS

[75] Inventors: Douglas A. Dayger, Binghamton; Michael D. Hryck, Endwell; Dean W. Skinner, Binghamton; Gerald R. Westcott, Endicott, all of N.Y.

[73] Assignee: International Business Machines Corporation, Armonk, N.Y.

[21] Appl. No.: 338,709

[22] Filed: Jan. 11, 1982

[51] Int. Cl.[3] ..... B41J 9/00

[52] U.S. Cl. ..... 101/93.03; 101/93.29; 400/157.3

[58] Field of Search ..... 101/93.03, 93.29; 400/157.3

[56] References Cited

U.S. PATENT DOCUMENTS

| | | | |
|---|---|---|---|
| 3,183,830 | 5/1965 | Fisher et al. | 101/93 |
| 3,241,480 | 3/1966 | Cunningham | 101/93 |
| 3,872,788 | 3/1975 | Palombo | 101/93.14 |
| 4,027,761 | 6/1977 | Quaif | 101/93.03 X |
| 4,189,246 | 2/1980 | Kane et al. | 400/144.2 |
| 4,192,230 | 3/1980 | Blom et al. | 101/93.03 |
| 4,236,447 | 12/1980 | Matsuzaki et al. | 101/93.29 X |
| 4,262,591 | 4/1981 | Cook | 400/124 X |
| 4,280,404 | 7/1981 | Barrus et al. | 400/157.3 X |
| 4,286,516 | 9/1981 | Wertanen et al. | 101/93.03 |
| 4,293,888 | 10/1981 | McCarty | 400/144.2 X |
| 4,347,786 | 9/1982 | Sweat, Jr. et al. | 101/93.03 |
| 4,368,666 | 1/1983 | Kozawa et al. | 101/93.03 X |

FOREIGN PATENT DOCUMENTS

| | | | |
|---|---|---|---|
| 2249538 | 6/1975 | France | 101/93.03 |

OTHER PUBLICATIONS

Deetz, Xerox Disclosure Journal, vol. 4, No. 2, Mar.-/Apr., pp. 157–158.

*Primary Examiner*—Edgar S. Burr
*Assistant Examiner*—John A. Weresh
*Attorney, Agent, or Firm*—John S. Gasper

[57] ABSTRACT

A hammer timing control system for a line printer has a register for storing a digital delay value related to the actual flight time of a controlled print hammer. A delay counter activated by an initiate fire pulse counts timing pulses until the count equals the delay value in the register. A comparator generates a fire signal when the count equals the delay value in the register. The counter continues counting pulses to a second count whereupon the fire signal is terminated. The second count is either decoded or compared with a predetermined quantity in a second register to terminate the fire signal. The counter may also be an up/down counter which counts up to delay and down to terminate the fire signal. Delay values can be stored in an external memory device such as a magnetic disk for transfer to the individual registers for each of the print hammers.

7 Claims, 7 Drawing Figures

CONTROL SYSTEM FOR TIMING HAMMERS OF IMPACT PRINTERS

FIELD OF THE INVENTION

This invention relates to high speed printers and particularly to a control system for accomplishing improved registration of printed characters in an electromechanical printer system.

BACKGROUND OF THE INVENTION

In high speed on-the-fly line printers a plurality of print hammers usually arranged in a row are selectively operated to strike the type faces on a constantly moving type carrier. The type carrier may be a revolving flexible band, belt, chain or train or a rotating drum. The print hammers are generally operated electromechanically preferably using electromagnetic actuators including an armature which when the electromagnet is energized, i.e. fired, propels an impact element or hammer from a rest position to the point of impact. Commonly, the armature stroke is stopped, i.e. seals, before impact while the hammer element continues in free flight to the point of impact. At the instant of impact, the hammer rebounds to be restored to the rest position where after a brief period of settling comes to rest ready to be fired.

Good registration of the printed characters requires that hammers be controlled so that impact occurs at the exact time that the desired characters become aligned with the selected print hammer/print position. It is further desirable to be able to terminate the energization of the electromagnet at or slightly after the time the armature seals, thereby saving energy and to be able to accommodate for the period during which hammers are settling in preparation for repeat firing. It is also desirable that the flight times be easily changed to accommodate variances in hammer operating characteristics during a relatively extended use period and that these changes be made without the need for altering control circuitry.

Various control schemes have been devised for operating print hammers to compensate or adjust for variation in the actual flight times of the print hammers due to variances in printer operating characteristics. Basically these control schemes introduce variable delay circuits into the hammer fire circuitry. While some of these systems may largely dispense with the arduous and time consuming task of manually adjusting hammer flight time, they are essentially inadequate for achieving reliable precision hammer flight control required for very high printing speeds, e.g. where the type carrier speeds greatly exceed 300 inches per second. Also they lack the capability to be easily and readily adapted to control the time for terminating the energization of the electromagnet and/or to make accommodation for the settling time of the hammers before they are again fired. Most prior art control schemes require complex timing controls and/or require changes in circuitry or circuit components to make the adjustments which compensate for changes in the operating characteristics.

BACKGROUND ART

U.S. Pat. No. 3,183,830 issued May 18, 1965 to D. M. Fisher et al discloses a print registration control in which misregistration of printed characters is corrected by delaying the individual signals applied to the respective hammer operating solenoids. For this purpose, a variable one-shot circuit is provided for delaying the operation of a fixed delay one-shot circuit which controls the energization of the solenoid winding for a fixed time interval. A variable resistor which determines the discharge time of a capacitor is adjusted to alter the delay period of the variable one-shot circuit so that all printed characters in a line of print are in registration.

U.S. Pat. No. 3,872,788 issued Mar. 25, 1975 to G. A. Palombo describes a closed loop system wherein a variable delay circuit is introduced into the command input to the hammer. The variable delay circuit is a counter presettable to a predetermined delay count condition stored in a storage counter. The delay circuit counter is reset after it has achieved a full count condition to the initial desired delay count condition by a feed back pulse from a hammer fire latch which effects the transfer of the stored count condition from the storage counter to the delay counter. Alternatively, the delay counter continues to count pulses from a clock controlled pulse generator after the delay counter has initiated the hammer firing and until such time as the delay counter again reaches the initial preset count condition. A hammer initiated fire pulse of a time duration equal to the full count of the delay hammer maintains the pulse generator on until the delay counter reaches the initial preset count condition. The hammer pulse provided by a monostable circuit has a fixed time duration.

U.S. Pat. No. 4,286,516 issued Sept. 1, 1981 to H. Wertanen describes an electronic control for timing hammers which utilize digital logic circuitry which varies the timing of pulses that drive hammers in an impact printer. The control controls the timing of the firing pulse to each hammer by retarding it or advancing it from a nominal built-in time delay to compensate for differences in spacing between printed columns. Variations are made in the electrical circuitry to adjust the spacing. The electronic control includes a field alterable preprogrammed read only memory consisting of driver/decoding circuits connectable for feeding through a plurality of settable switches. The settable switches produce weighted on signals which in combination with the counter controlled multiplexor control the timing of firing pulses from the multiplexor to selected print hammers. Adjustment in spacing is made by changing the setting of the switches and hence the weighting of the on signal. Drivers for the print hammer consist of one-shot multivibrators driving Darlington circuit devices to generate fixed width drive pulses.

SUMMARY OF THE INVENTION

The electronic control of the present invention provides for automatic flight time compensation and other print hammer controls without complex timing arrangements and without the requirement for making circuit changes to make adjustments made necessary by changes in the operating characteristics of the print hammers. Other advantages may also be obtained from the invention.

Basically, the hammer timing control system of the present invention comprises register means for continually storing a digital delay fire quantity representative of the acutal flight time of a controlled hammer, clock means for producing a continuous stream of timing pulses, a delay fire counter means operable in response to an initiate fire signal for counting timing pulses produced by the clock means and hammer fire circuit means for producing a fire hammer signal in response to a count condition in the counter means which corresponds with the delay fire quantity in the register means. The control system further provides circuit means responsive to a second count condition of the counter means for controlling the hammer fire circuit means to terminate the fire hammer signal at the predetermined second count condition of the counter means. In one embodiment, the system includes a decode connected to the output of the counter means for detecting the second count condition and for generating a fire terminate signal. In another embodiment, the control system provides a second register which stores a terminate fire quantity representing a fixed time after the initiate fire signal and prior to impact. The fire control system further provides circuit means responsive to a second count condition of the counter means corresponding with the terminate fire quantity in the second register means for terminating the fire hammer signal. In the preferred embodiment, the control system utilizes a signal comparison circuit for comparing the count condition of the counter means alternatively with the delay fire quantity in the first register means and with the terminate fire quantity in the second register means. Gating circuits operable by separate control signals connects the registers to the comparison circuits.

BREIF DESCRIPTION OF THE DRAWINGS

DETAILED DESCRIPTION OF THE INVENTION

Figure 1:
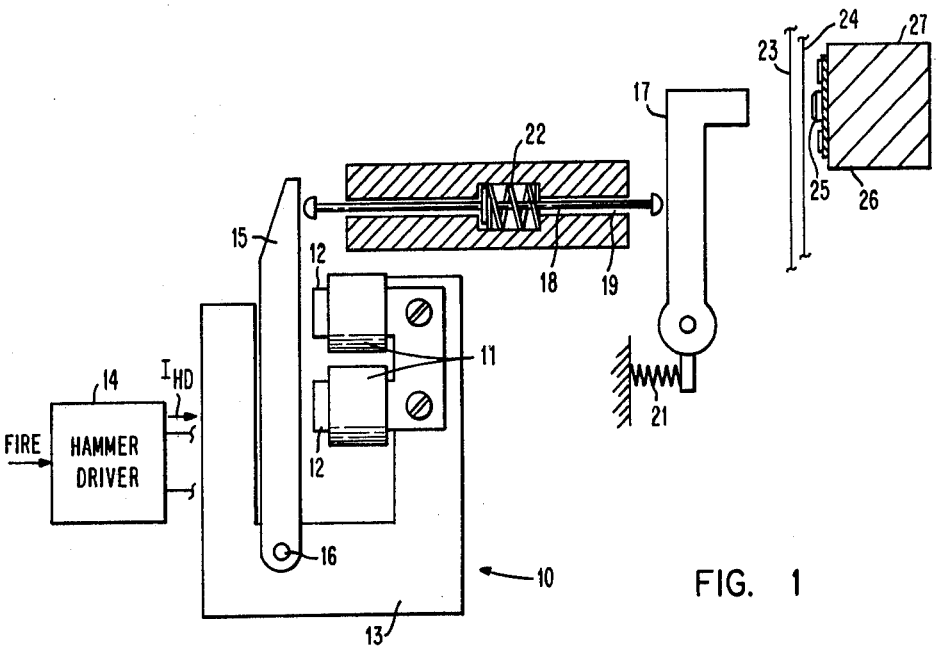
FIG. 1 is a schematic drawing of a printer mechanism and an electromagnetic print hammer useful with the control system of the invention.

As seen in FIG. 1, a print hammer mechanism for a single print position of a high speed printer and suitable for practicing the invention includes an actuator 10 consisting of coils 11 on poles 12 of stationary magnetic core 13. Coil 11 when energized by current pulses $I_{HD}$ from hammer driver circuit 14 drives an armature 15 pivoted at 16. The mechanical energy induced in armature 15 is coupled to hammer element 17 by means of pushrod 18 supported in guideway 19 of block member 20. In the non-energized condition of coil 11, hammer 17 and pushrod 18 are loaded by bias springs 21 and 22 to rest against the backstop of core 13. When coil 11 is energized, armature 15 overcomes the bias force of springs 21 and 22 and drives hammer 17 until armature 15 seals, i.e. is stopped and held against poles 12. When armature 15 seals, hammer 17 has received all available energy and therefore continues moving under its own momentum until impact forcing paper 23 and ribbon 24 against type face 25 of the moving print band 26 which is backed by stationary platen 27. After impact with type face 25, hammer 17 rebounds from the paper 23 and type face 25, moving armature 15 from its sealed position to the rest or backstop position. Armature 15 and hammer 17 bounce around the rest position until settling is finally attained. The period from the instant the hammer driver 14 is activated to the instant when hammer 17 is in the steady state rest position is referred to as the hammer-busy period $T_{HB}$. It is sometimes called the hammer settle out time and is the limiting factor in determining the maximum fire repetition rate. Firing a hammer 17 before it has settled would result in erratic variations in flight time and impact force.

While a single print hammer mechanism is described in FIG. 1 it is understood that a line printer in which the invention is practiced would utilize a plurality of such print mechanisms; for example, one for each of a plurality of print positions located along a print line. A multiple print hammer assembly for a line printer which may be employed for the present invention can be seen and understood more fully by reference to U.S. Pat. No. 3,241,480 issued Mar. 22, 1966 to J. M. Cunningham.

Figure 2:
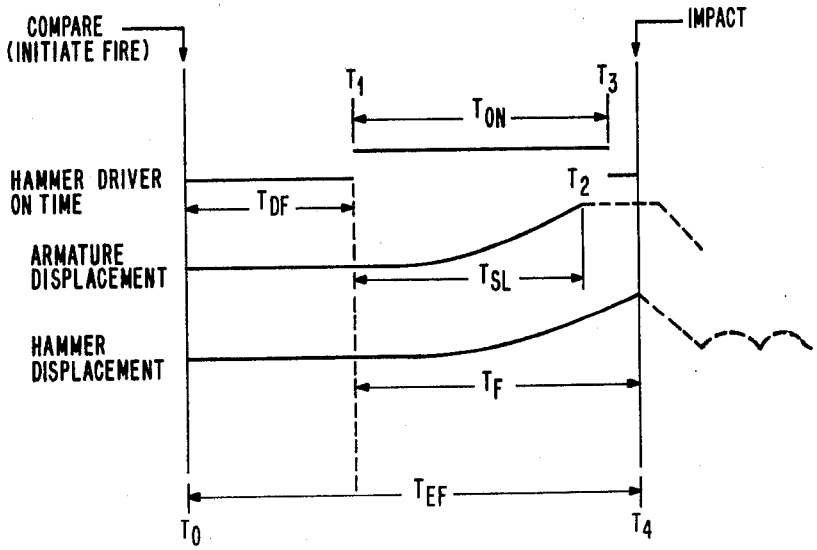
FIG. 2 is a timing diagram explaining the operation of the print hammer mechanism of FIG. 1.

The timing of the operation of the print mechanism of FIG. 1 is understood further by reference to FIG. 2. As shown in the timing circuit chart of FIG. 2, the real hammer flight time $T_F$ is defined as the elapsed time from the instant hammer driver 14 is activated by a fire control pulse $I_{HD}$ to the instant impact occurs. The seal time $T_{SL}$ is the interval between the instant driver 14 is activated by the fire control pulse $I_{HD}$ and the instant armature 15 seals against poles 12 of core 13. During the interval $T_F$-$T_{SL}$ hammer 17 is in free flight. Since no additional energy can be transferred to hammer 17 once armature 15 seals against poles 12 driver 14 need not continue to energize coil 11 and the pulse I may be terminated. In other words, hammer driver 14 need remain active only for the period $T_{ON}$ which is in accorance with the preferred embodiment of this invention is equal to or greater than the period $T_{SL}$ over the operating range of hammer 17. This is defined by the following expression $T_{ON}=T_F-T\Delta$ where $T\Delta$ is the minimum free flight time and driver 14 turns off no sooner than armature seal time but before impact time under normal operating conditions. Further as seen in FIG. 2, hammer driver 14 is turned on in accordance with this invention at $T_1$ which occurs at some variable delay time $T_{DF}$ after initiate fire time at $T_0$.

In the preferred manner of practicing the invention, the effective hammer flight time $T_{EF}$ as shown in FIG. 2 is a constant for all print hammers. Hammer driver on time $T_1$ occurs after a delay interval $T_{DF}$ which is variable dependent on the actual flight time characteristics of each hammer. Terminate fire time $T_3$ which can vary for each hammer depending on the operating characteristics thereof always occurs at or after the hammer seals at $T_2$ but before impact at $T_4$.

Figure 3:
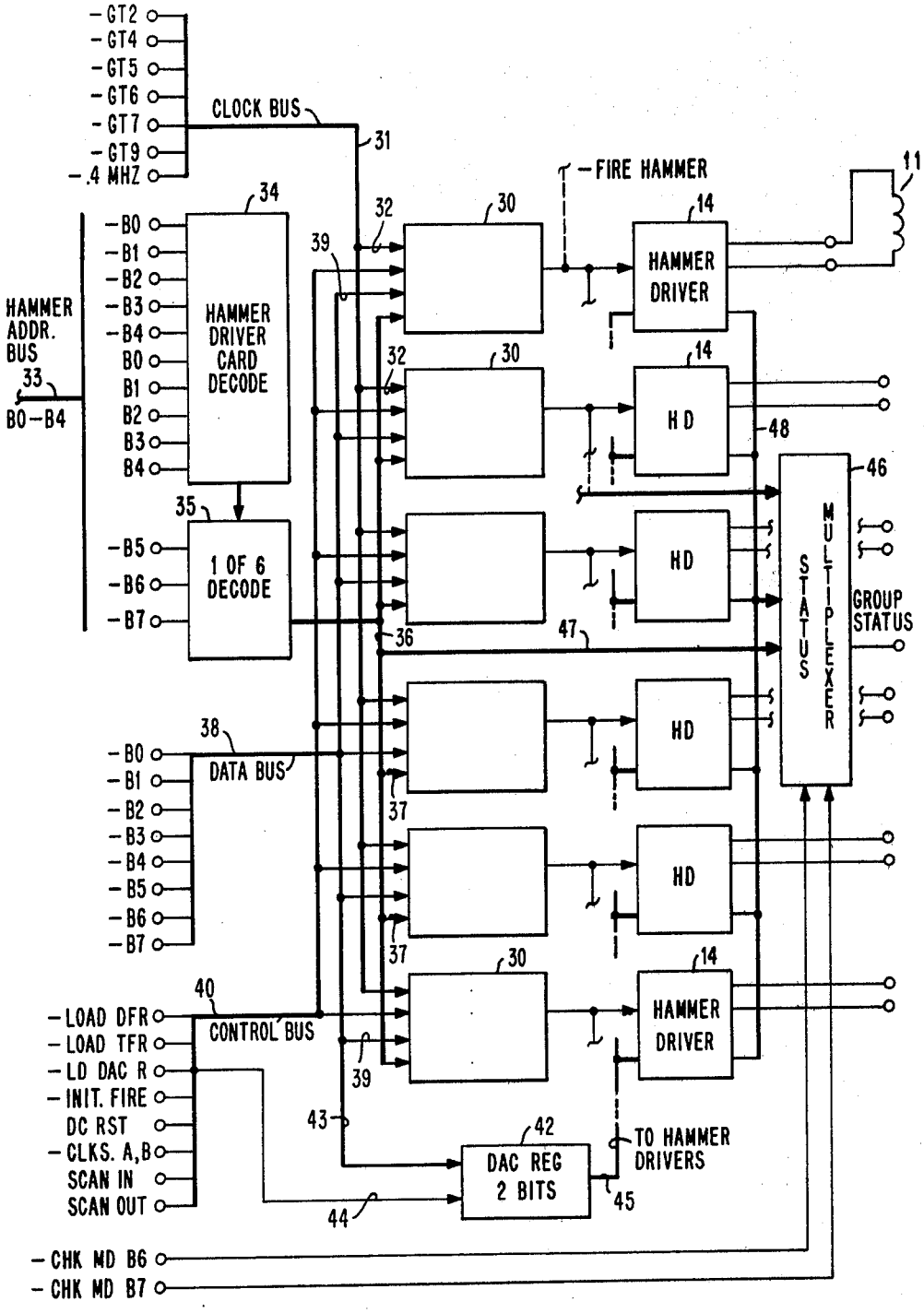
FIG. 3 is a diagram of an electronic system for controlling the timing of a plurality of print hammer mechanisms of the type shown in FIG. 1.

In a printer control system for a group of a set of print hammers, as seen in FIG. 3, coil 11 is connected to be energized by hammer driver circuits 14. Each hammer driver circuit 14 is connected to an individual fire control circuit 30 which functions to control the turn-on and turn-off times of driver circuits 14 which in turn controls the drive current. Current is supplied to coil 11 for operating the individual print hammers. Timing pulses generated by a suitable timing source such as a free running clock which may be part of a control system are supplied through clock bus 31 which has input connections 32 to the flight control circuits 30. Hammer selection is obtained through hammer address bus 33 connected to the interconnected address decode 34 and the 1 of 6 decode circuitry 35 to hammer select bus 36 having a second input 37 to the flight control circuits 30. Flight control data for timing the turn-on time and terminate fire data for controlling the turn-off time of the individual hammer driver circuits are provided on data bus 38 with inputs 39 to the flight control circuits 30. Various control signals are supplied to the flight time controls 30 via bus 40 with inputs 41. DAC register 42 has an input 43 connected to data bus 38 and a control connection 44 to control bus 40. The output 45 from DAC register 42 is connected to the hammer driver circuits 14. DAC register 42 functions to convert digital data to analog signals for adjusting the hammer driver circuits 14 to change the current levels and hence the energy supplied by the hammer driver circuits to coil 11. Such energy level changes are desirable where printing is to be done on print media having different thicknesses such as 1-12 layer paper forms of the type used for recording multiple copies of business and/or scientific data. A driver circuit suitable for use with this invention which includes DAC register for adjusting the current, i.e. energy levels, of the driver circuit is more fully described in the co-pending application of R. W. Arnold and D. W. Skinner, Ser. No. 274,848, filed June 18, 1981. Energy level selection is made through a multiple position forms switch or the like located on the printer and operated at the time paper is loaded into the printer whereupon the printer controls which may include a microprocessor which monitors the forms switch loads the energy level data form data buss 38 on connection 43 to DAC register 42 concurrently with the generation of a load signal LD DAC R applied to connection 44 of control bus 40.

The control system may also include a status multiplexor 46 connected to address bus 36 and to the hammer driver circuits 14 for the purpose of checking the condition of the hammer driver circuits as a group or individually.

Other control signals applied to control bus 40 also from external controls which might include a microprocessor or the like include the following:

1. —LOAD DFR— This signal is used for loading flight control data on data bus 38 into the flight control circuits 30 addressed by hammer decode logic 35.
2. —LOAD TFR— This signal is used for loading the terminate fire data on bus 38 into flight control circuits 30 addressed by the hammer decode logic 35.
3. —INIT. FIRE— This signal is used for initiating flight control circuit operation which compensates for the different flight times of the print hammers as determined by the flight control data and which ultimately generates the fire ham. control to hammer driver circuits 14. The INIT. FIRE signal is preferably generated by external controls which compare the contents of a print line data storage device with a type carrier image storage device in synchronism with the movement of the type carrier and generates the signal when a comparison occurs. This signal is timed to be generated on control bus 40 to the flight time control circuits 30 as so to always occur at a fixed time $T_{EF}$ prior to the impact of the print hammers.

Other control signals which may be applied to control bus 40 by external controls will be discussed hereinafter.

Figure 4:
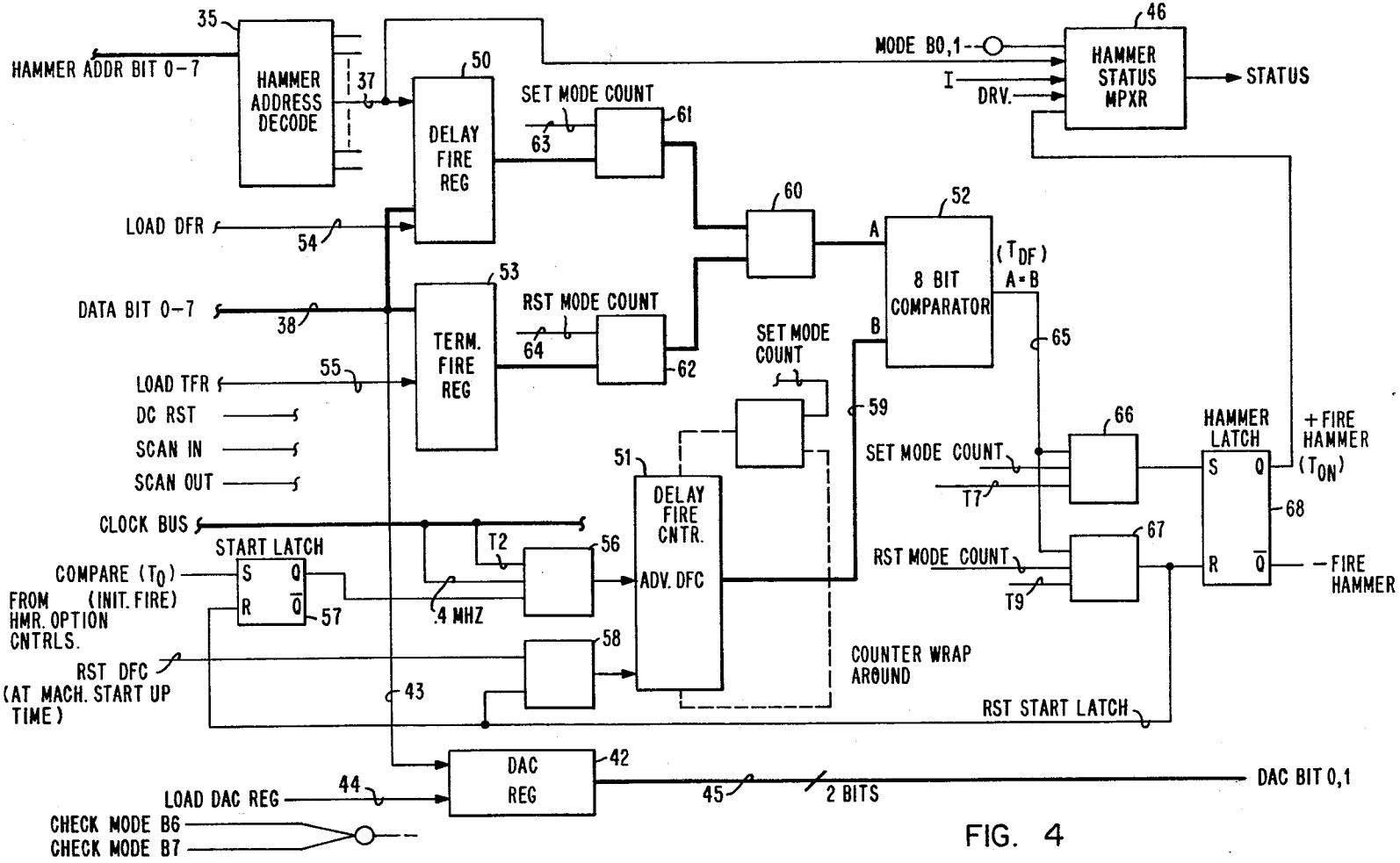
FIG. 4 is a detailed circuit diagram of a portion of FIG. 3 relative to the hammer flight time compensation and control.

In the preferred embodiment in which the invention is practiced, each flight control circuit 30, as shown in greater detail in FIG. 4, comprises delay fire register 50, counter 51 and comparator circuit 52 for each print hammer. A terminate fire register 53 which preferably is shared with other flight control circuits for controlling all or a group of print hammers is also provided. Delay fire register 50 stores a delay value for delaying the time when the print hammer is to be fired, that is when the hammer driver is turned on for energizing coil 11. Terminate register 53 stores a time value which controls when hammer firing is terminted, that is when driver circuit 14 is turned off ending the supply of current to coil 11. Counter 51 functions to time both events.

The time delay value stored in delay register 50 is an 8 bit binary number loaded from data bus 38 by the printer system control signal —LOAD DFR applied on line 54 of control bus 40 along with the hammer address on address bus 33 though address decode logic 34 and 35 through bus 36 and input 37. The terminate value stored in terminate register 53 is also loaded from data bus 38 by the system control signal —LOAD TFR on line 55 from control bus 40. Either the time delay or the terminate value can readily be changed to adjust for new or variable operating conditions by supplying new values on data bus 38 along with address data on bus 33 from any external source under external system control which may be a microprocessor using microcode or other programming. Where the delay and terminate values remain valid over an extended period of operation, they can remain in their respective registers after loading without change. Altenatively, should some of or all of the print hammers need adjustment, a single, several or all of the delay values can be easily adjusted by loading new values directly into the desired registers. Since the hammer flight time $T_F$ for the various hammers is a variable parameter due to various factors inherent to the structure of the electomagnets and the hammer mechanisms, the delay values stored in register 50 are likewise varied. The real flight time $T_F$ is a measurable quantity and can be expressed as a digital value. Known devices for measuring flight time use transducers such as an impact bar located at the position normally occupied by the type carrier. The controls for determining the delay value of a given hammer count timing pulses from a clock from the instant a hammer driver is turned on until an impact signal is generated by the transducer. The process may be repeated several times for each hammer. The number of timing pulses is then averaged and compared with a quantity representing a suitable design standard and any differences calculated for use as a time delay value. The delay values for all the print hammers are similarly determined and then stored. Delay values can be determined at the time of printer manufacture and recorded on a suitable permanent record such as a magnetic disk or tape which can be supplied with the printer. This record can, in accordance with this invention, be used to precondition the printer controls in advance of beginning the printing as part of the startup procedures. That is, the delay values recorded on the permanent record are read into the delay registers 53 as previously described. Because the impact transducers cannot be located at the precise impact position of the type carriers, some anomalies may exist in the delay values. The present invention permits individual or multiple adjustment of the delay values applied to the delay register 53 by the recorded values. Additionally, after prolonged use where accumulation of dirt, aging or other conditions occur new delay values would be required. New sets of values may be again obtained by actual measurement and stored as in the case of the original values.

Counter 51 is a multiple stage binary counter preferably having wraparound capability. Counter 51 is connected by AND circuit to the $T_2$ and 0.4 MH lines of clock bus 31 and the Q output of start latch 57. The S input of start latch 57 is connected to the hammer selection controls of the printer system which generates a compare or INIT. FIRE signal which enables counter 51 for counting timing pulses gated through AND circuit 56 at $T_2$ time. Counter 51 has a reset input connection through OR circuit 58 for receiving a reset pulse RSTDFC which clears or initializes the count in counter 51 at the beginning of each print operation. Counter 51 has a multi-bit output connection 59 for applying the count condition signal to input B for comparison by comparator 52.

Comparator 52 also has a multi-bit input A connected to OR circuit 60. The delay fire register 50 is connected through AND circuit 61 to one input of OR circuit 60. Terminate register 53 is connected through AND circuit 62 to the other input of OR circuit 60. A set mode count signal on input 63 to AND circuit 61 gates the delay value stored in delay register 50 through OR circuit to input A of comparator 52 for comparison with the count condition on connection 59 to input B. A RST mode count signal on line 64 to an input of AND circuit 62 gates the terminate time value in terminate fire register 53 through OR circuit 60 to input A of comparator 52 for comparison with a second count condition appearing on connection 59 to input B.

Comparator 52 has an output line 65 connected to and input of AND circuits 66 and 67 connected respectively to the S and R inputs of hammer latch 68. Set mode count and $T_7$ clock signals applied to AND circuit 66 gate a fire equal compare signal on line 65 when the count condition of counter 51 equals the delay value of register 50 to set hammer latch 68. This produces a Fire HAM. signal at the Q terminal of latch 68 turning on driver circuit 14. RST mode count signal and a $T_9$ clock pulse from clock bus 31 produce a terminate equal compare signal through AND circuit 67 when the count condition of counter 51 after one or more wraparound operations equal the terminate value from register 63 to reset hammer latch 68. This causes hammer latch 68 to terminate the Fire HAM. signal at the Q output thereby turning off the driver circuit 14. Line 69 connecting the output of AND circuit 67 to OR circuit 58 and the reset input of start latch 57 supplies a signal which resets start latch 57 blocking further counting operation by counter 51 are resets counter 51 to the initial or clear count condition. The control circuit repeats the operation for successive printing operations and compensates for different flight times of the various hammers in accordance with the delay values specified in the delay register 50.

Terminate fire values in register 53 preferably are designed to shut off driver circuit 14 at a fixed time before impact. This value can be the same for all hammers. The terminate fire value is also selected in accordance with this invention to occur after the armature of the electromagnet actuator is stopped and held at the sealed position.

The delay fire value stored in register 50 can also be used to compensate for other operating conditions. It is a specific feature of this invention that the delay fire value stored in register 50 also account for the flight time changes related to the energy of the hammer as set by the adjustment of driver circuits 14 through the operation of DAC register 42. In determining the delay values for the various energy levels, the hammers are operated with the impact bar installed as previously described at the different energy levels and delay values computed accordingly. The set of values for each energy level are stored on a recording device such as a disk as previously described as part of the startup routine for the control system. These values may be stored as a set of tables to be read into a random access memory device which is part of the control system for later use as needed during the course of printing on different thickness forms.

A specific set of binary delay values for a given hammer for use in a printer wherein the type carrier speed is 500 inches per second for printing at four different energy levels is as follows:

25, 52, 102, 214

The actual delay time represented by a specific binary value in the register is equal to that value times the period of the $T_2$ clock.

In addition to compensating for flight time variations of the print hammers and the energy level at which they are operated, the delay value stored in register 50 may take into account other operating parameters. Specifically, one operating parameter which could be readily incorporated into the delay value of a given hammer is the time increment required to delay the firing of the hammer dependent on its position relative to the first print hammer in a row of print hammers in a belt or chain type printer. Thus the delay value for a print hammer at print position 45 may have an additional $\Delta$ time added to the normal flight time delay for that hammer to compensate for the flight time variation and for the timing of the firing of the hammer relative to the motion of the type belt. A specific example for a delay value which includes the added print position for a print hammer operating with a type carrier having a velocity of 500 inches per second is as follows:

40, 67, 117, 229

Thus it will be seen that a very precise control has been provided which is very versatile and requires a minimum of time, utilized simple timing arrangement and does not require circuit changes to adjust hammers to different operating condition with different flight time characteristics.

Figure 5:
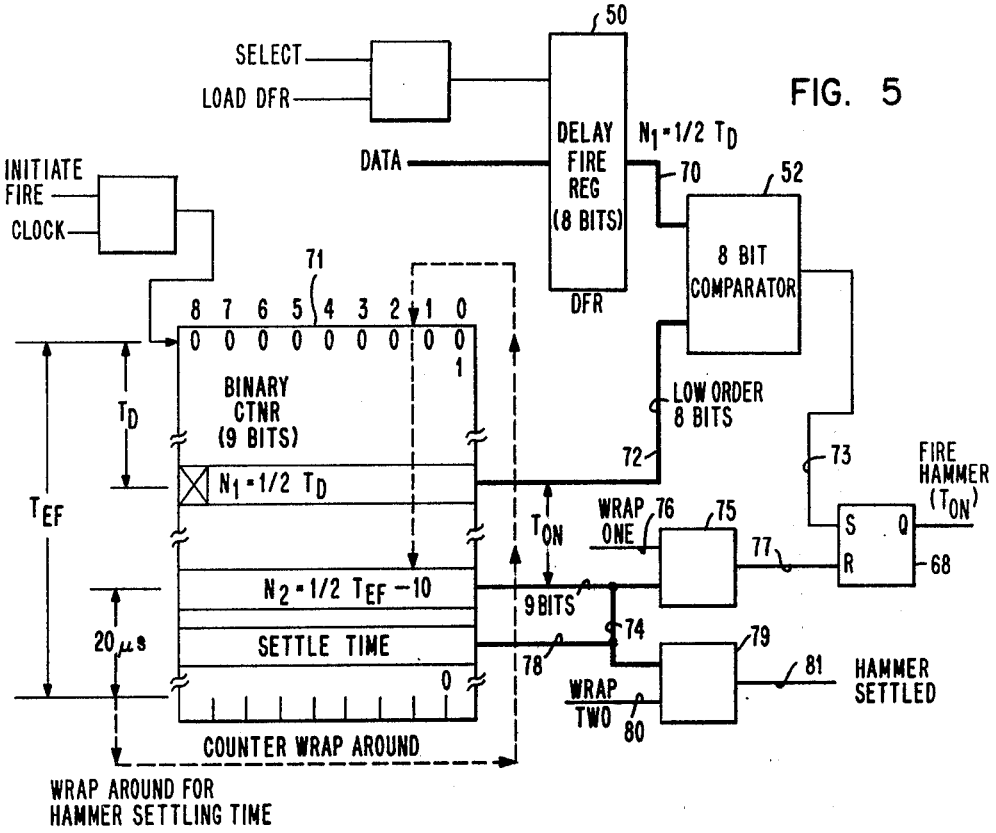
FIG. 5 shows a second embodiment of an electronic circuit diagram which incorporates the print hammer controls of the invention.

FIG. 5 shows a second embodiment having an alternative arrangement which also uses a single counter for timing both the delay of the hammer firing and the termination of the hammer firing signal. In addition, the counter functions to determine the time at which the hammer settle condition has occurred. As seen in FIG. 5, delay register 50 has a direct multi-bit connection 70 to input A of comparator 52. Counter 71 is a 9 bit counter for example having the lower 8 bits applied by connection 72 to the B input of comparator 52. The output of comparator 52 is connected by line 73 to the S input of hammer latch 68 to turn on the hammer driver circuit 14 when an equal compare signal appears on line 73. Connection 74 connects the 9 bits of counter 71 to AND circuit 75 which has a second input 76 and an output 77 connected to the R input of hammer latch 68. Connection 79 connects the 9 bits of counter 71 to AND circuit 79 which has input 80 and has an output 81 for connection to external control for recognizing the hammer settle condition signal appearing on line 81.

The circuit arrangement of FIG. 5 operates in substantially the same manner as the previous embodiment. Delay values are loaded in delay register 50 for comparison by comparator 52 with the lower order count condition appearing on connection 72 as the counter is advanced by clock pulses gated through AND circuit 56 upon the initiation of firing by an INIT. FIRE pulse. When the compare equal occurs, a compare equal signal on line 73 sets latch 68 turning on the driver circuit. Counter 71 continues counting timing pulses until the counter is filled whereupon it wraps around and continuous counting until it reaches the high order condition. At this point a Wrap One signal, generated by a counter full flag, appearing at line 76 is grated through AND circuit 75 applying a reset signal on line 77 resetting hammer latch 68 and turning off the driver circuit 14. The Wrap One signal causes the clock to switch to a lower frequency. Timing pulses continue to advance counter 71 at a slower rate to the full count condition whereupon it wraps around a second time. A Wrap Two signal appearing on line 80 is gated through AND circuit 79 when counter 71 reaches the upper level count condition identified as settle time. The external control, seeing the hammer settle signal on line 81 can then proceed to fire the hammer again.

In this embodiment, counter 71 times the delay value, the terminate value and further provides an indication of the settle time which allows the hammer to be refired.

Figure 7:
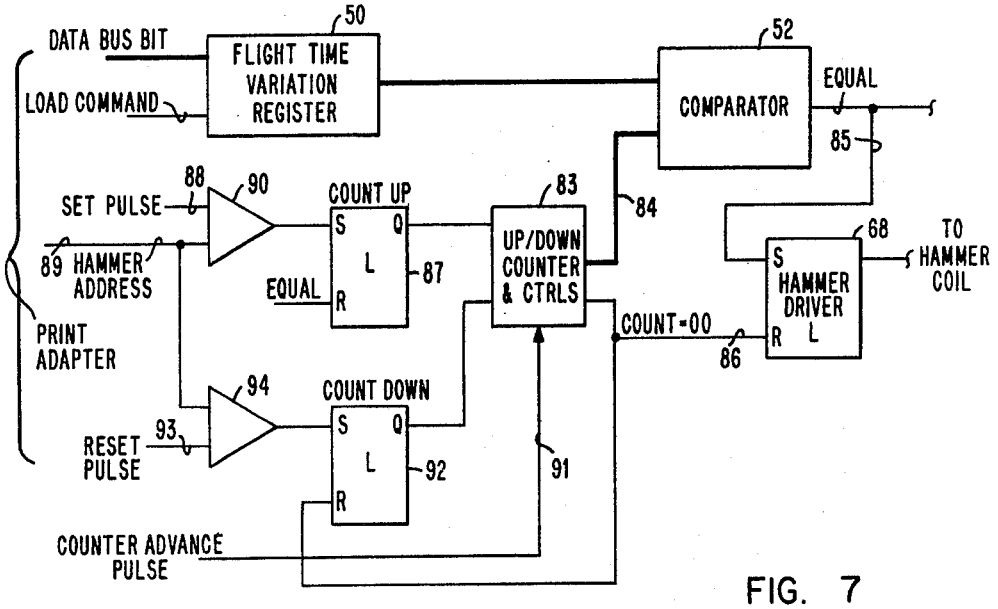
FIG. 7 is a schematic circuit diagram showing a third embodiment of an electronic control system for practicing the invention.
Figure 6:
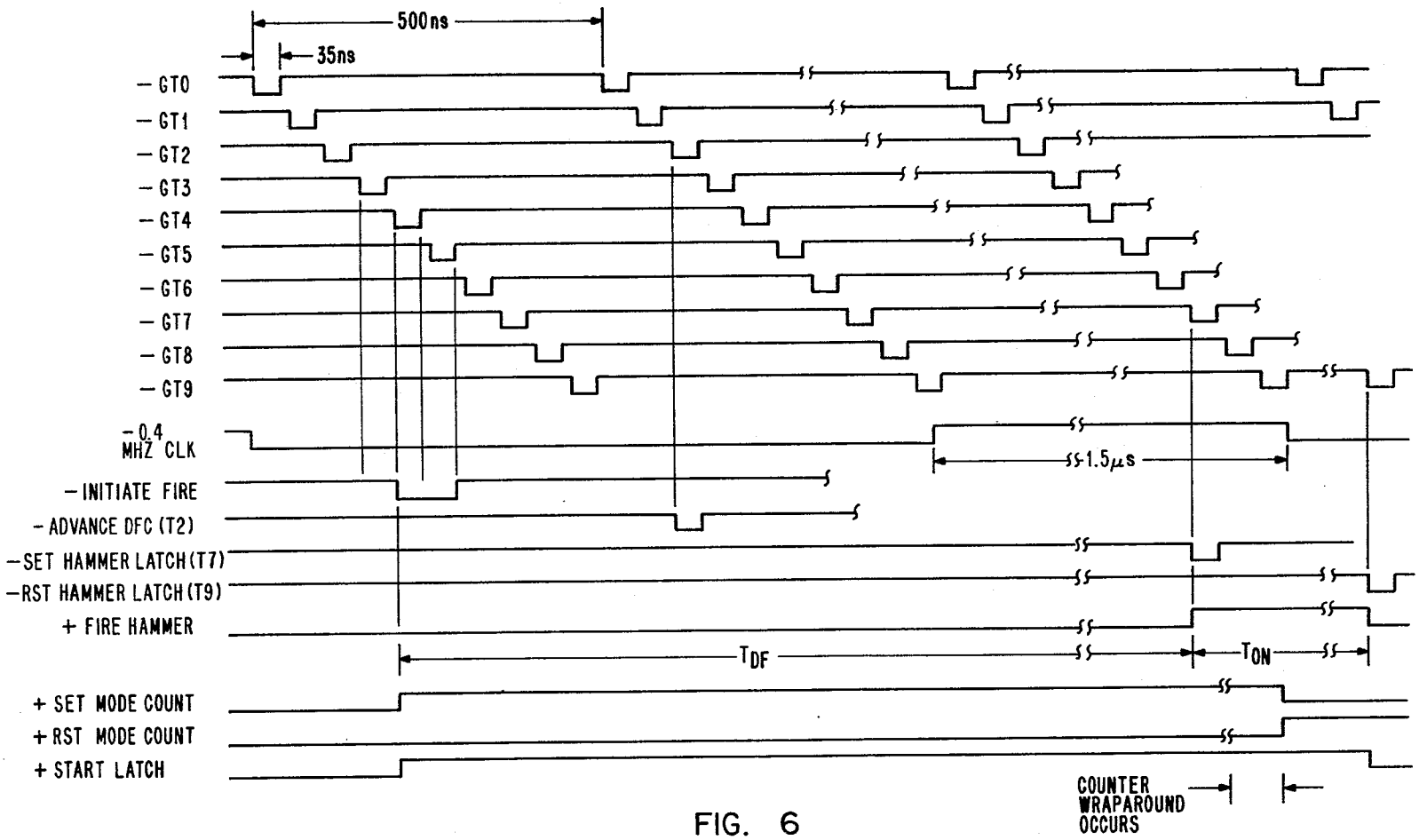
FIG. 6 is a timing diagram useful for explaining the operation of the circuits of FIGS. 3 and 4.

FIG. 7 shows a third embodiment in which the counter means for timing the delay of the hammer fire signal in accordance with the delay value stored in register 50 is a bi-directional counter which is controlled to count in one direction for timing the delay and in the other direction for timing the termination of hammer firing. As seen in FIG. 7, counter 83 is an up/-down counter having multi-bit output connection 84 to the B input of comparator 52 which is also connected at input A to delay register 50. The output of comparator 52 is connected by line 85 to the set input of hammer latch 68 and when an equal compare signal is generated by comparator 52 on line 85 latch 68 sends a fire signal to the driver circuit 14. Hammer latch 68 has its R input connected to the zero count line 86 of counter 83. Count up control is provided by count up latch 87 which is set by the coincidence of a set pulse on line 88 and a hammer address input on line 89 to AND circuit 90 thereby gating timing pulses on line 91 to advance counter 83 in the up count direction. Count up latch 87 has its R input connected to output line 85 from comparator 52 for resetting by an equal compare signal produced by the comparison of the delay value in register 50 at input A with the count condition of counter 83 appearing on line 84 at input B. When count up latch 87 is reset, counter pulses on line 91 are blocked from advancing counter 83 further.

Count down control is provided by count down latch 92 which is set by the coincidence of the hammer address on line 89 which gates a reset pulse on line 93 through AND circuit 94. When set, count down latch 92 gates timing pulses to advance counter 83 in a downward direction. When the zero count condition is reached, a count equals zero on line 86 resets hammer latch 68 turning off the driver circuit 14. The count equals zero signal appearing on line 95 resets count down latch 92 thereby blocking further timing pulses from advancing counter 83.

This arrangement would have utility where the terminate fire time and delay fire times are equivalent where the desired on time of the hammer driver exceeds the delay time value. Means may be provided for delaying the beginning of the down count. Such means may take various forms but might include means for delaying the gating of the reset pulse on line 93 to AND gate 94 for setting the count down latch 92. Such count down delay control may be part of the control system which might include a microprocessor of a printer control and may be in the form of a software or microcode control for operating the microprocessor.

Thus it will be seen that a flight time hammer control has been provided which is simplified using counters and registers along with comparator circuits which eliminate the need for making circuit changes to accommodate various operating parameters and which uses simple timing control. The invention in its several embodiments offers versatility in controlling the time of firing of a hammer to accommodate for various operating conditions including the inherent differences in the flight times of the hammer as well as other properties including changes in energy level to accommodate print media of different thicknesses and in print hammer position in a row of hammers of a line printer. Other advantages may be also realized from the invention.

While the invention has been particularly shown and described with reference to preferred embodiments thereof, it will be understood by those skilled in the art that the foregoing and other changes in form and details may be made therein without departing from the spirit and scope of the invention.

We claim:

1. A system for timing the impact of a set of hammers in an on-the-fly speed line printer with the alignment of type of a moving type carrier with said hammers, said hammers each being driven by actuating means energizable by firing pulses, said hammers having inherent flight times which may differ relative to a predetermined flight time, the combination comprising, pulse generating means for selectively supplying initiate fire pulses at a fixed predetermined time preceding impact for selectively driving said print hammers, and flight time control means including means responsive to said initiate fire pulses for delaying the energization of said actuating means to compensate for the difference in said inherent flight times of said print hammers including a source of regularly recurring timing pulses, bi-directional counter means connected to said pulse generation means and said source, said counter means being operable in response to said initiate fire pulses for counting said timing pulses in one direction for supplying a first count and in a second direction for supplying a second count, register means for storing variable delay values representing a predetermined number of said timing pulses related to said inherent flight times of corresponding print hammers, comparsion circuit means connected to said register means and said means for comparing said delay value in said register means with the timing pulse count in said counter means and for generating an equal compare signal when said delay value and said first count are equal, switch means connected to said comparison means and said counter means, said switch means being operable to generate a delayed fire pulse in response to said equal compare signal from said comparison means and to terminate said fire pulse in response to said second count from said counter means, operating circuit means connected to said switch means for operating said actuating means, said switch means being turned on by said delayed fire pulse from said switch means and turned off by the termination of said delayed fire pulse by said switch means.

2. A system for timing the impact of a set of hammers in accordance with claim 1 in which said bi-directional counter is turned off in response to said equal compare signal from said comparison circuit prior to being turned on for counting said timing pulses in said second direction.

3. A system for timing the impact of a set of hammers in accordance with claim 2 in which said bi-directional counter is an up/down counter operable in an up direction for counting a first count for comparison by said comparison circuit means and in a down direction for counting said second count for terminating said fire pulse.

4. In a system for timing the impact of a set of hammers in accordance with claim 3 in which said first and second counts are equal to said delay value in said register means, and said counter means is interrupted between said counts for a predetermined interval relating to said flight times of said hammers.

5. A system for timing the impact of a set of hammers in an on-the-fly high speed line printer with the alignment of type of a moving type carrier with said hammers, said hammers each being driven by actuating means energizable by firing pulses, said hammers having inherent flight times which may differ relative to a predetermined flight time, the combination comprising, pulse generating means for selectively supplying initiate fire pulses at a fixed predetermined time preceding impact for selectively driving said print hammers, and flight time control means including means responsive to said initiate fire pulses for delaying the energization of said actuating means to compensate for the difference in said inherent flight times of said print difference including a source of regularly recurring timing pulses, counter means connected to said pulse generation means and said source, said counter means is a wraparound counter operable in response to said initiate fire pulses for counting sad timing pulses from said source, said wraparound counter being further operable by said timing pulses for providing a first timing pulse count and for completing at least one wraparound operation to a second timing pulse count, register means for storing variable delay values representing a predetermined number of said timing pulses related to said inherent flight times of corresponding print hammers, comparison circuit means connected to said register means and said counter means for comparing said delay value in said register mean with said timing pulse count in said counter means, said comparison means being operative for generating an equal compare signal when said delay value and said first timing pulse count are equal, switch means operable for providing a time delayed fire pulse in response to said equal compare signal and for terminating said time delayed fire pulse in response to said second timing pulse count, and operating circuit means for operating said actuating means connected to said switch means, said operating circuit means being turned off by said delayed fire pulse and turned off by said switch means terminating said delayed fire pulse.

6. A system for timing the impact of a set of hammers in accordance with claim 5 in which said wraparound counter is operable by said timing pulses from said source for completing a second wraparound operation to a third timing pulse count for producing a signal indicating a hammer settle condition.

7. A system for timing the impact of a set of hammers in accordance with claim 5 in which said flight time control further includes second register means for storing a terminate value representing a predetermined number of timing pulses from said source for controlling the duration of said fire pulses, and said comparison circuit means is further connected to said second register means and said counter means for comparing said terminate value in said second register means with said timing pulse count in said counter means, said comparison circuit means being further operable for operating said switch means to turn off said operating circuit when said second timing pulse count of said wraparound counter means equals said terminate value in said second register means.

* * * * *

UNITED STATES PATENT AND TRADEMARK OFFICE

CERTIFICATE OF CORRECTION

PATENT NO. : 4,440,079

DATED : April 3, 1984

INVENTOR(S) : D. A. Dayger

It is certified that error appears in the above—identified patent and that said Letters Patent is hereby corrected as shown below:

In the Specification, column 7, line 34, "and" should read --an--.

Column 8, line 49, "utilized" should read --utilizes--,

In the Claims, column 10, line 39, after "on-the-fly", insert --high--.

Column 10, line 66, after "said" (first occurrence), insert --counter--.

Column 11, line 52, change "difference" to --hammers--.

Column 12, line 5, change "sad" to --said--.

Column 12, line 16, change "mean" to --means--.

Column 12, line 27, change "off" to --on--.

Signed and Sealed this

*Twelfth* Day of *February 1985*

[SEAL]

*Attest:*

DONALD J. QUIGG

*Attesting Officer* *Acting Commissioner of Patents and Trademarks*